United States Patent [19]

Putkowski

[11] Patent Number: 4,535,689

[45] Date of Patent: Aug. 20, 1985

[54] PRESS WITH WEDGE

[76] Inventor: Ladislao W. Putkowski, 2350 Bridletown Cir., Unit 1710, Scarborough, Ontario M1W 3E6, Canada

[21] Appl. No.: 525,519

[22] Filed: Aug. 22, 1983

[30] Foreign Application Priority Data

Aug. 25, 1982 [CA] Canada ..... 410056

[51] Int. Cl.[3] ..... B30B 1/40

[52] U.S. Cl. ..... 100/214; 72/452; 83/627; 100/229 R; 100/232; 100/291; 425/451.7

[58] Field of Search ..... 100/214, 291, 292, 232, 100/229 R; 425/451.7, DIG. 129, DIG. 221, 411; 72/452; 83/613, 627

[56] References Cited

U.S. PATENT DOCUMENTS

| | | | |
|---|---|---|---|
| 174,058 | 2/1876 | Berry | 100/291 X |
| 188,290 | 3/1877 | Gilman | 100/291 X |
| 188,513 | 3/1877 | Golding | 100/291 X |
| 353,606 | 11/1886 | Stupakoff | 100/291 |
| 370,509 | 9/1887 | Webb | 100/291 X |
| 1,765,762 | 6/1930 | Hanna | 100/291 X |
| 2,204,151 | 6/1940 | Rodefer | 425/DIG. 129 |
| 3,122,033 | 2/1964 | Riemenschneider | 100/291 X |
| 3,208,105 | 9/1965 | White | 100/291 X |
| 3,667,891 | 6/1972 | Gelin | 425/451.7 X |
| 3,743,469 | 7/1973 | Gibbons | 100/291 X |
| 3,844,157 | 10/1974 | Bachmann | 100/291 X |
| 3,913,438 | 10/1975 | Walters | 100/291 X |
| 3,939,686 | 2/1976 | Walters | 100/291 X |
| 4,339,940 | 7/1982 | Mackay | 72/425 X |

FOREIGN PATENT DOCUMENTS

| | | | |
|---|---|---|---|
| 2017676 | 10/1971 | Fed. Rep. of Germany | 100/214 |
| 2408939 | 1/1975 | Fed. Rep. of Germany | 100/291 |

*Primary Examiner*—Billy J. Wilhite

*Attorney, Agent, or Firm*—Rogers, Bereskin & Parr

[57] ABSTRACT

A press having a pre-stressed frame, to reduce the energy required in each pressing cycle, and in which oppositely acting wedges provide the clamping force. The mold or other structure to be pressed is assembled outside the press and then is slid on guide rails into the press with very small clearances. The press can also be used for molds or dies fixed to stationary or movable platens.

20 Claims, 21 Drawing Figures

PRESS WITH WEDGE

This invention relates to a press which employs wedges to provide the clamping forces.

Presses are used for numerous operations, such as molding, die casting, hydroforming, vacuum and pressure forming, forging, hobbing, stamping, fine blanking, powder compaction, and others. Many of these processes require very short but high power strokes. In conventional presses the main clamping device is used not only for opening and closing the mold or other structure to be pressed, but also for the final clamping stroke. This arrangement is uneconomical both initially and in operation. During each clamping operation the frame must be stretched to the full clamping force, which requires a large amount of energy which is lost after each clamping cycle.

The invention in one of its aspects provides a press in which the functions of opening and closing, and performing the clamping stroke, are separated. The opening and closing operation is performed outside the press, typically by inserting the item or other thing to be clamped within a structure to be compressed. The closed structure is then moved into the press, the frame of which is prestressed, and the clamping forces are applied. Since the frame is prestressed, preferably to more than the maximum clamping power used, no energy is required to stretch the frame during each operation and only very little energy is needed to eliminate the sliding gaps between the press structure and the structure to be compressed. Wedges are then used to provide the necessary clamping force.

In one aspect the invention provides a press comprising:

(a) a frame forming a closed loop;

(b) a first pressure surface disposed within said loop;

(c) a movable platen within said loop, which has a second pressure surface opposed to and spaced from said first pressure surface to permit the introduction between said first and second pressure surfaces of a structure to be compressed;

(d) means supporting said movable platen for movement thereof towards and away from said first pressure surface;

(e) wedge means for moving said movable platen towards said first pressure surface to compress a structure disposed between said first and second pressure surfaces, said wedge means including first and second wedges which taper in opposite directions, and which are movable in said directions and means slidably co-operating with said wedge means and adapted to cause movement of the movable platen towards the first pressure surface in response to movement of the wedges in said directions, without imparting any substantial lateral force to the movable platen; and (f) drive means for propelling said first and second wedges in opposite directions, to move said movable platen relative to said first pressure surface.

In another aspect the invention provides in a press the improvement comprising first and second wedge means for producing pressing forces in said press, means mounting said first and second wedge means for movement in opposite directions for producing said pressing forces, and actuating means for moving said first and second wedge means simultaneously in opposite directions.

Further objects and advantages of the invention will appear from the following description, taken together with the accompanying drawings which show various embodiments of the invention, and in which.

Figure 1:
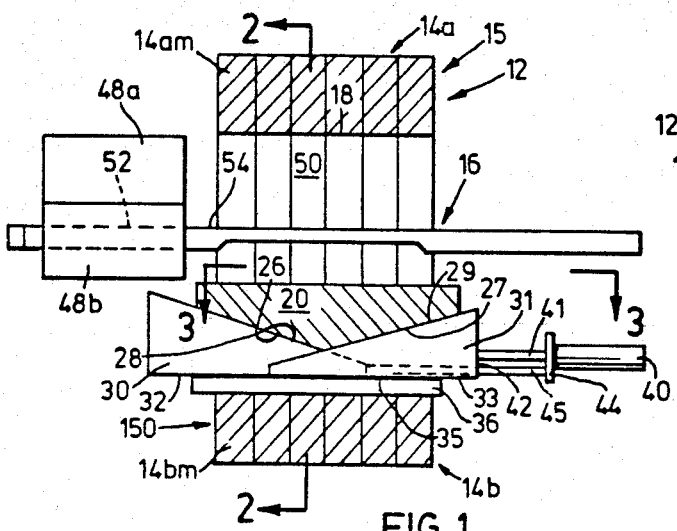
FIG. 1 is a longitudinal sectional view of a press according to the invention.
Figure 5:
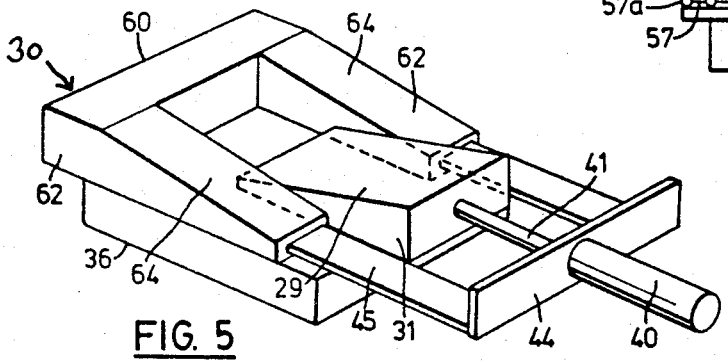
FIG. 5 is a perspective view of the set of wedges of the FIG. 1 press.
Figure 5A:
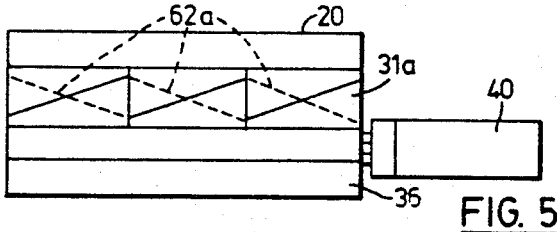
Figure 18:
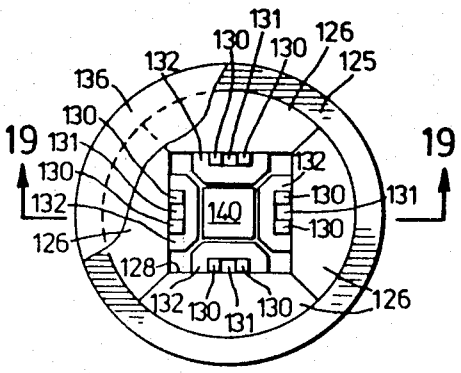
Figure 19:
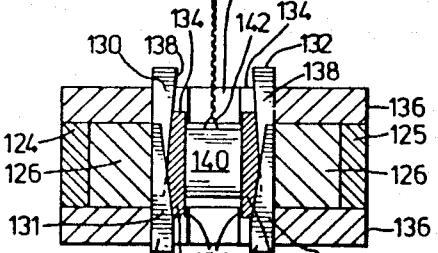
Figure 8:
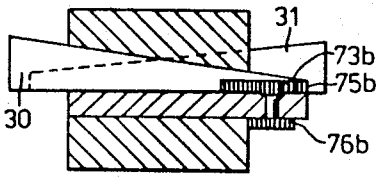
Figure 9:
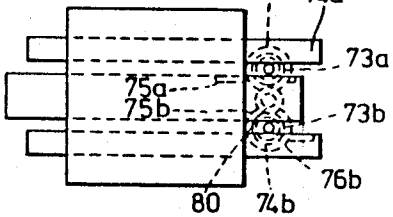
Figure 6:
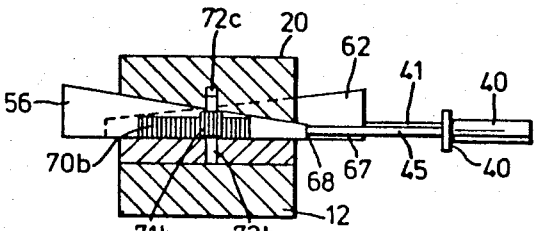
Figure 7:
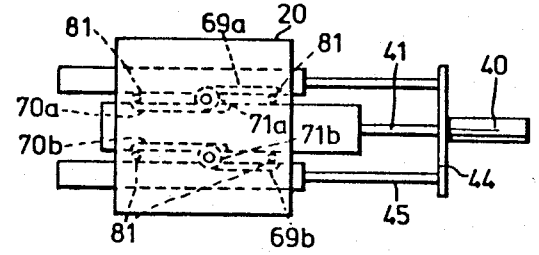
Figure 10:
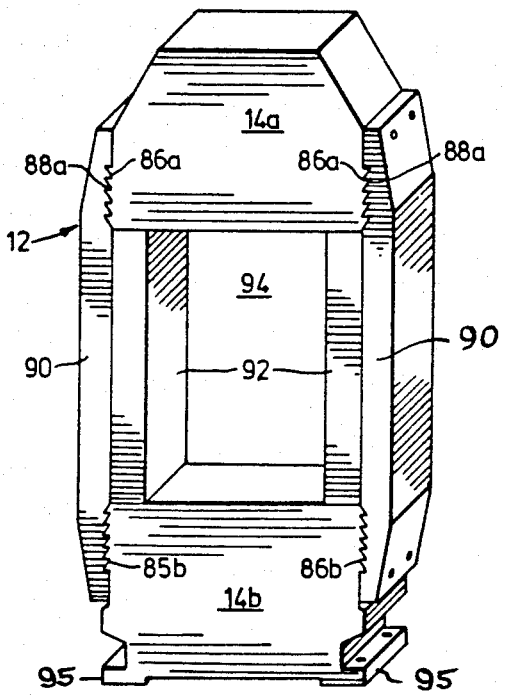
Figure 11A:
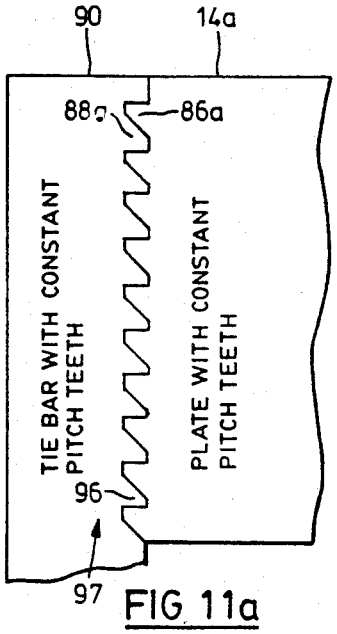
Figure 11B:
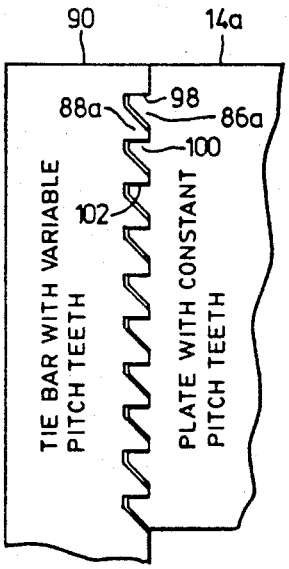
Figure 12:
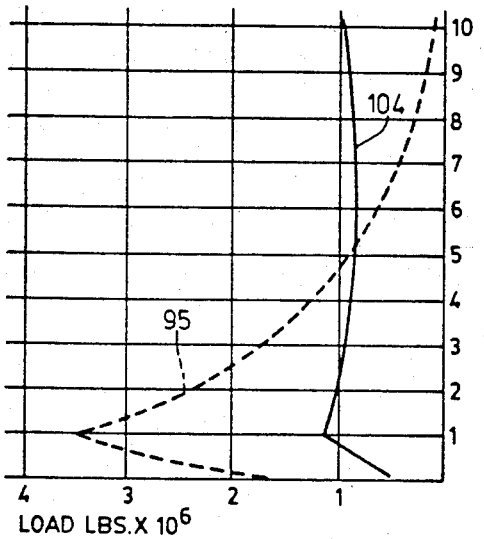
Figure 17:
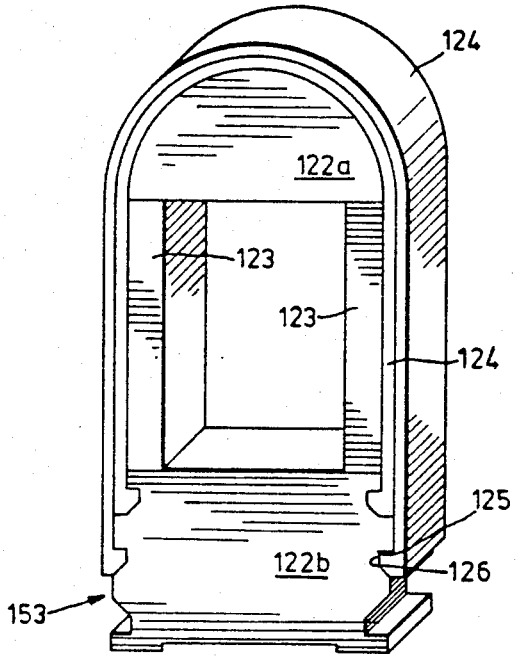
Figure 13:
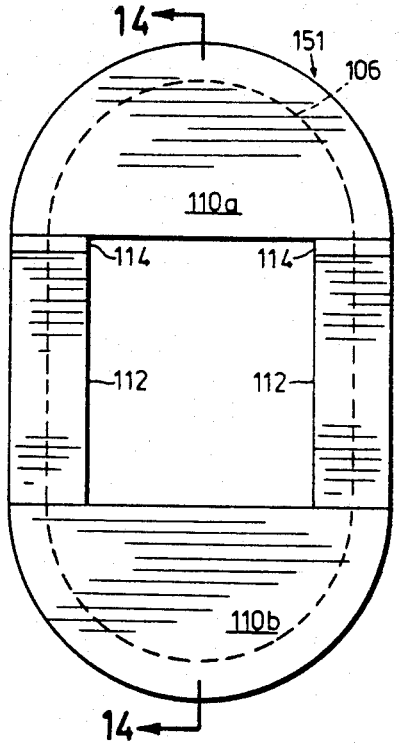
Figure 14:
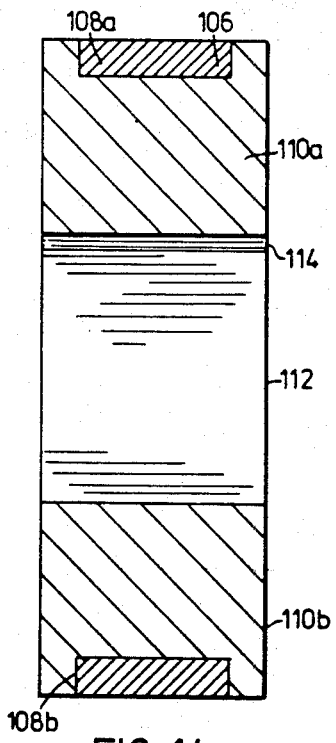
Figure 15:
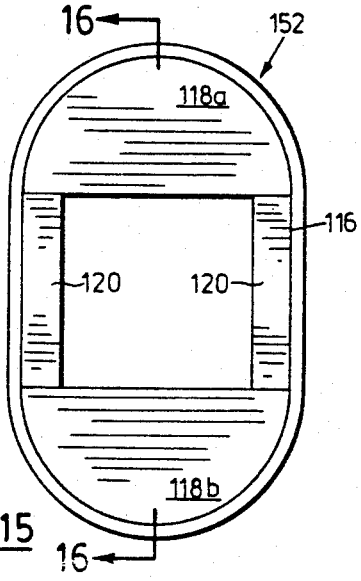
Figure 16:
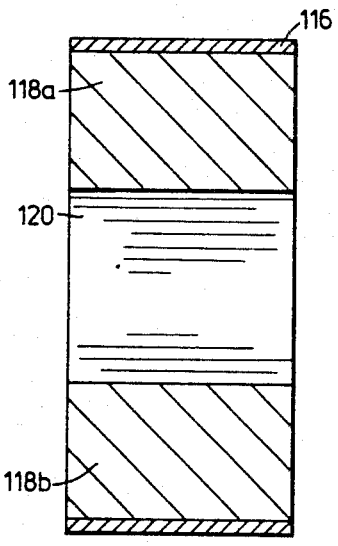

FIG. 5*a* is a side view showing a modification of FIG. 5;

FIG. 6 is a side view of the wedges of FIG. 5 and showing a driving arrangement therefor;

FIG. 7 is a top view of the wedges and driving arrangement of FIG. 6;

FIG. 8 is a side view of a modified driving arrangement for the wedges of FIG. 5;

FIG. 9 is a top view of the driving arrangement of FIG. 8;

FIG. 10 is a perspective view of an alternative form of prestressed frame module for the press of FIG. 1;

FIGS. 11*a* and 11*b* are side views showing teeth for the frame of FIG. 10;

FIG. 12 is a graph showing load distributions for the FIGS. 11*a* and 11*b* teeth;

FIG. 13 is a front view showing a module frame for the press of FIG. 1;

FIG. 14 is a sectional view along line 14—14 of FIG. 13;

FIG. 15 is a front view of an alternative frame module;

FIG. 16 is a sectional view along line 16—16 of FIG. 15;

FIG. 17 is a perspective view of another variant of the frame module;

FIG. 18 is a top view partly in section, of a further modified press according to the present invention; and FIG. 19 is a sectional view, taken along line 19—19 of FIG. 18.

Figure 2:
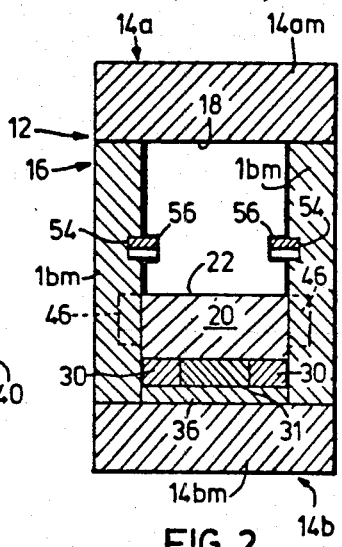
FIG. 2 is a view taken along lines 2—2 of FIG. 1.
Figure 3:
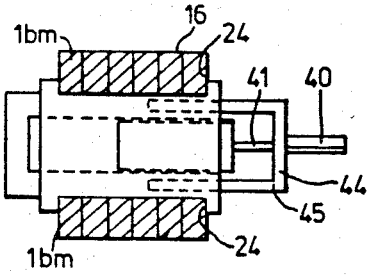
FIG. 3 is a view taken along lines 3—3 of FIG. 1.

Reference is first made to FIGS. 1 to 3, which show a press 10 according to the invention and intended for molding or die forming operations. The press 10 includes a frame 12 which, in principle, comprises top and bottom yokes 14*a*, 14*b* held together by side members 16 as best shown in FIG. 2. The frame 12 is pre-stressed, as will be described shortly, to more than the maximum clamping power of the press so that no energy is required to stretch the frame during each clamping operation.

In this particular embodiment, the frame is of a modular construction as indicated diagrammatically in FIGS. 1 and 3. The frame is shown as comprising six modules, which are indicated by the reference numeral 150. The modules may be of the form shown in FIGS. 13 and 14; 15 and 16; or 17 (to be described). As best shown in FIG. 2, each module comprises respective portions 14*am*, 14*bm* of the yokes 14*a*, 14*b* and portions 16*m* of the side members 16. These portions 14*am*, 14*bm* and 16*m* are secured together to form a closed loop, so that the respective modules 150 can be handled as separate units. To assemble the frame 12, the modules 150 are assembled side by side. For convenience, they are assembled together in a support frame (not shown) which ensures correct alignment of the modules 150. Then, the other components of the press (described below) are assembled in the frame 12 formed of these modules 150. The modules are accurately formed so that, in use, the load applied to the frame 12 is evenly distributed between the modules 150.

This modular design enables the size of the frame 12 to be readily changed to accommodate different sizes of articles that are to be pressed. It is simply necessary to assemble together the required number of modules 150.

The lower surface 18 of the upper yoke 14*a* constitutes a first pressure surface (a separate platen fixed to the upper yoke 14*a* can also be used to provide this pressure surface). A movable platen 20 is located well below the upper yoke 14*a* and has an upper surface 22 facing the first pressure surface 18 and constituting a second pressure surface. The movable platen 20 is guided for vertical movement on the side members 16 by slots 24 in its sides.

The movable platen 20 also has two sloping lower surfaces 26 and 27 which are supported on correspondingly inclined upper surfaces 28 and 29 of actuating wedges 30 and 31 which are movable back and forth horizontally. Both wedges 30 and 31 have respective horizontal lower surfaces 32 and 33 which are supported on the horizontal upper surface 35 of a stationary member 36. Stationary member 36 is in turn fixed to the lower yoke 14*b*, and distributes any applied force to the modules 150. Of course, the wedges need not act directly on platen 20; an intermediate member having surfaces 26, 27 may be employed.

The wedge 30 is formed as a U-shaped wedge which slides to the right as shown in the drawings to produce a clamping force. The U-shaped wedge 30 includes a base 60 and a pair of spaced tapered wedge arms 62 one located on each side of the other wedge 31 (see FIG. 5). The wedge arms 62 and the wedge 31 are supported on the horizontal upper surface of member 36, with the wedge 31 located between the wedge arms 62. The inclined upper surfaces 28, 29 like the surfaces 26 and 27 of the platen 20 have the same though opposite slopes so that uniform upward movement of the movable platen 20 will be achieved when wedges 30, 31 are properly aligned and move at the same speed in opposite directions. The upper surface 28 of the wedge 30 is formed from the combined area of the upper surfaces 64 of wedge arms 62 and is preferably equal to the area of the upper surface 29 of wedge 31 so that the forces needed to move each wedge 30, 31 will be as nearly the same as possible.

The actuating wedges 30 and 31 are propelled horizontally back and forth by a conventional hydraulic cylinder 40. The piston rod 41 of cylinder 40 is connected at 42 to the wedge 31. The cylinder 40 is itself mounted on a support 44 having arms 45. The arms 45 are fixed to the wedge arms 62.

Appropriate lubrication may be provided between the surface 35 of the stationary member 36 and the surfaces 32 and 33, and also between the surfaces 26–29. Since the lower surfaces 32, 33 of the wedges 30, 31 are horizontal, no lateral force can be applied to the assembly comprising the wedges 30, 31 and the platen 20. In use, to load the press, the cylinder rod 41 is drawn into the cylinder 40, thereby moving the wedge 30 to the left and the wedge 31 to the right, as viewed in FIG. 1. The slots 24 in the platen 20 ensure that it stays aligned in the press. The press can then be loaded with a mold, as described below.

FIG. 1 also shows a pair of mold or die halves 48*a*, 48*b* assembled together and ready to be inserted into the space 50 between the first and second pressure surfaces 18, 22. Mold or die halves 48*a*, 48*b* are constructed so that they can be separated to receive or discharge any desired item or thing to be clamped or molded, and then assembled together into a single mold structure as shown. The details of the mold or die, which can e.g. be an injection mold or which can receive and transmit pressure to an item, are not shown since they are conventional.

The lower mold or die half 48*b* is supported, by means of slots 52 in its sides, which have a sliding fit on a pair of rails 54 which extend through the space 50. The rails 54 are secured to the side members 16. The arrangement is dimensional so that when the mold or die halves are slid into the space 50, there are only small clearances between the top of the upper mold or die half 48*a* and the first pressure surface 18, and between the bottom of the lower mold or die half 48*b* and the second pressure surface 22 [assuming that wedges 30, 31 have been withdrawn (as described above)].

In operation, the material or other item to be molded or pressed is placed within the mold or die halves 48*a*, 48*b* which are then assembled together and closed outside the press. The mold or die halves 48*a*, 48*b* are then slid along the rails 54 into the space 50 in the press. (If the mold is an injection mold, it is filled with hot plastic or other material after it has been inserted into the space 50 and clamped.) At this time the upper surfaces 56 of the slots 52 in the lower mold or die half 48*b* rests on the tops of the rails 54. The movable platen 20 and the wedges 30, 31 are as indicated dimensioned to allow a small clearance between the bottom of the lower mold or die half 48*b* and the second pressure surface 22 at this time.

When the mold or die halves are in position, cylinder 40 is actuated to drive the actuating wedge 30, 31 towards one another, i.e. the wedge 30 moves to the right and the wedge 31 moves to the left as shown in FIG. 1, closing the clearances and lifting the movable platen 20 and the mold or die halves so that the rails 54 are approximately centered in the slots 52. (As shown, the rails 54 are of lesser height than the slots 52 in this position.) This ensures that the rails will not be stressed during the clamping operation. As the wedges 30, 31 continue to be driven in their respective and opposite directions, clamping force is exerted on the mold or die halves 48*a*, 48*b* to perform the required molding or other operation. Since the frame 12 is prestressed and no energy is required to stretch it, only a small quantity of energy is required to eliminate the sliding gaps between the mold or die halves 48*a*, 48*b* and the pressure surfaces 18, 22 and to supply the necessary clamping forces.

Although only one mold or die has been shown, preferably two molds or dies will be used so that while one is being loaded or unloaded, the other can be processed in the press.

Preferably, the lower surfaces 26,27 of the platen 20 are symmetrical, to aid substantially parallel movement of the movable platen 20 under maximum power and under unbalanced loading conditions. The use of two opposed wedges 30, 31 ensures that no lateral force is applied to the platen 20. These features are extremely difficult to obtain in conventional presses without very high cost.

Figure 4:
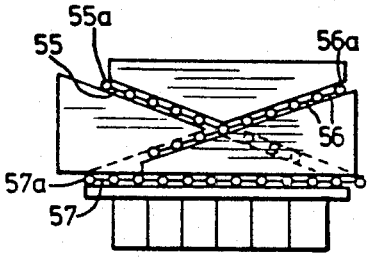
FIG. 4 is a side view showing the wedges and movable platen of the FIGS. 1 to 3 press with rollers therebetween.

It will be appreciated that the movement of the actuating wedges 30, 31 can be programmed as required for structural foam molding, hobbing, or other processes. The sliding wedge surfaces can be treated with anti-friction materials as required, or they may be equipped with rollers to reduce friction. Such rollers are diagrammatically indicated in FIG. 4, which shows elongated rollers (i.e. roller bearings) 55,56, 57 held in elongate cages 55*a*, 56*a*, 57*a* respectively. Two sets of rollers 55 and two corresponding cages 55*a* are provided. These are located between the upper surfaces 64 of the wedge arms 62 and the surface 26 of the platen 22. The rollers 56 and associated cage 56*a* are located between the upper surface 29 of the wedge 31 and the surface 27 of the platen 20. Thus, the rollers 55,56 permit relative movements between the wedges 30, 31 and the platen 20. The rollers 57 are located between the wedges 30, 31 and the stationary member 36, to permit horizontal movement of the wedges 30, 31 relative to the stationary member 36. The rollers 57 are provided in three parallel sets or rows, each of which has its own associated cage 57*a*. Two outer rows of rollers 57 are located between the wedge arms 62 and the stationary member 36. A third row of rollers 57 is located between these two rows, and between the wedge 31 and the stationary member 36. This permits the wedges 30, 31 to travel in opposite horizontal directions.

It is also possible for each of the wedge arms 62 and wedge 31 to comprise two or more wedges, arranged in a series. By way of example, FIG. 5*a* shows an arrangement in which each of the wedge arms 62 and the wedge 31 comprises three wedges denoted 62*a* and 31*a* respectively. The front wedge arm 62 has been omitted from FIG. 5*a* for clarity.

Various types of drives may be used to propel wedges 30, 31. As discussed above, a hydraulic cylinder 40, having a piston rod 41, can be used. The cylinder 40 is fixed to be base of a support 45 whose side arms 44 are secured to wedge arms 62. The cylinder rod 41 protrudes through the base and is connected to the wedge 31. When the piston rod 41 retracts, wedge 31 moves to the right and wedge arms 62 of wedge 30 move to the left, and when the piston rod 41 extended the wedges 30, 31 again move in opposite directions. As shown in FIGS. 6 and 7, if high accuracy is desired, then rack teeth 69*a*, 69*b*, 70*a*, 70*b* are provided at the opposed sides of the respective wedges 30, 31 and engage idler pinions 71*a*, 71*b* rotatably mounted on shafts 72*a*, 72*b* fixed to the frame 12. The upper ends of the pinions 71*a*,71*b* or pinion shafts are accommodated in slots 72*c* in the movable platen 20. The pinions 71*a*, 71*b* prevent unequal movement of the wedges 30, 31 and ensure that wedge arms 62 move to the same extend in one direction as wedge 31 moves in the other direction. A variant of the wedge 30 discussed previously is shown in FIGS. 6 and 7. In this variant, the wedge arms 62 are separate and are not joined by a base 60 as previously shown.

Alternatively, as shown in FIGS. 8 and 9, the wedges 30, 31 may be powered directly by a pair of pinions, 73*a*, 73*b* engaging teeth 74*a*, 74*b*, 75*a*, 75*b* on the side faces of the wedges 30, 31. The pinions 73*a*, 73*b* are fixed to gears 76*a*, 76*b* rotatably mounted in the base member 36. The gears 76*a*, 76*b* are driven by a common driving pinion 80 powered by an electric, hydraulic or air motor (not shown). This ensures that equal displacement of the wedge arms 62 of the wedge 30 and of the wedge 31 occurs. Again, in FIGS. 8 and 9, the wedge arms 62 are shown separate from one another.

In each of the embodiments of FIGS. 6, 7 and FIGS. 8, 9, the movable platen is located for vertical movement by pins 81 which extend downwardly between the wedges and are received in guides (not shown) in the fixed platen or in the frame.

FIG. 10 shows an alternative form of prestessed frame which can be used for a one-piece or modular frame construction. As shown, the yokes 14*a*, 14*b* have teeth 86*a*, 86*b* respectively at their ends, which engage corresponding teeth 88*a*, 88*b* in tie bars 90. The tie bars 90 are prestressed (stretched) so that they are under a tension force which exceeds the maximum clamping force expected in the press. The tie bars 90 are maintained in their stretched condition by compression bars 92 which extend between the respective yokes 14*a*, 14*b* and hold the yokes apart. The space 94 between the yokes 14*a*, 14*b* and compression bars 92 accommodates the platen or platens, wedges and guide rails as described above. As shown, ends of the tie bars are tapered. The top of the yoke 14*a* comprises a flat portion and two sloping edge portions. The bottom yoke 14*b* is adapted to receive the tie bars 90 and includes feet 95 provided with holes for securing the frame 12 in position.

To assemble a frame of the kind shown in FIG. 10, the yokes 14*a*, 14*b* and the compression bars 92 are assembled together, and then the tie bars 90 are heated to a temperature sufficient to extend them to the required degree. The heated tie bars 90 are then fitted to the yokes and cooled, placing them under the required tension. Either the compression bars or the tie bars can then be used for mounting the mold sliding rails 54. Because the tie bars are prestressed, the energy that would otherwise be required to stress them during each clamping operation is saved. The conventional keys and screws used to locate and hold the parts together are not shown, for simplicity.

In a frame such as that shown in FIG. 10, it is desirable that the load on each mating pair of the teeth 86*a*, 86*b*, 88*a*, 88*b* be kept as uniform as possible. If the teeth were of constant pitch, as shown in FIG. 11*a* (which shows the teeth mating prior to prestressing), then the load would be highest on the first tooth and would be much less on each succeeding tooth, as shown in curve 95 in FIG. 12. Failure would then tend to begin at tooth 96 in FIG. 11*a*, as indicated by crack 97, and could eventually result in complete failure of the tie bar 90.

To avoid this difficulty, a tooth design as shown in FIG. 11*b* is preferred, in which the pitch or distance between teeth decreases for each tooth on the tie bar prior to prestressing, the yoke having constant pitch teeth. As shown in FIG. 11*b*, in the non-prestressed condition the gap at 98 is zero; the gap at 100 is the amount of expansion of one tooth under full tensioning or prestressing; the gap at 102 is the amount of expansion of two teeth under full tensioning, etc. The amount of expansion of each tooth is constant. Then, when the tie bars 90 are prestressed, each of the gaps 100, 102 etc. becomes substantially zero, provided that such gaps have been properly dimensioned for the particular prestress load to be applied. The stress distribution for the teeth is then shown at 104 in FIG. 12 and will be seen to be substantially uniform. This tooth design can also be used for frames which are not prestressed, in which case, when the frame is stressed (i.e. when clamping is occurring) the teeth will be approximately evenly loaded, and at other times there will be gaps between all the mating teeth except the first pair.

The tie bars can have constant pitch and the yokes or plates variable pitch if necessary.

FIGS. 13 and 14 show a frame module 151 which may be used in a frame of the form shown in FIGS. 1 to 3. The module comprises an integral annular ring 106 which at its top and bottom runs through slots 108*a*, 108*b* in upper and lower yokes 110*a*, 110*b*. The yokes 110*a*, 110*b* are held apart by compression bars 112. To prestress the frame, the yokes 110*a*, 110*b* are forced apart by any desired expansion means, such as hydraulic jacks, and stressing spacers 114 are inserted above the compression bars 112 to eliminate the spaces created by the stretching of the ring 106. The compression bars 112 and stressing spacers 114 are provided with slots corresponding to the slots 108*a*, 108*b*. The expansion means is then removed.

An alternative form of module is shown in FIGS. 15 and 16 and is designated 152. In this case there are no slots in the yokes or in the compression bars. A ring 116 is employed which is wider and thinner than the ring 106 of FIGS. 13 and 14. The ring 116 extends across the full width of this module 152. For this reason, the yokes 118*a* and 118*b* and compression bars 120 are provided with plain outer surfaces. To assemble this module, the yokes 118*a*, 118*b* and compression bars 120 are laid on a horizontal surface. Then, the annular ring 116 is heated to expand it. It is then dropped over the yokes and compression bars and allowed to cool. Once it is cool, the ring 116 is prestressed to the correct tension.

An alternative form of module is shown in FIG. 17 and is designated by the reference 153. It comprises a top yoke 122*a*, a bottom yoke 122*b* and compression bars 123. Around the top yoke 122*a* and the compression bars 123 U-shaped tension bars or strips 124 are positioned. As shown, two tension strips 124 are provided although just one stronger strip 124, or three or more tension strips 124, could be provided. Each end of each tension strip 124 is provided with a tooth 125, which extends across the width of the strip. These teeth 125 engage corresponding teeth 126 of the bottom yoke 122*b*. Again, each strip 124 could be provided with two or more teeth. This construction is assembled similarly to the frame shown in FIG. 10. The yokes 122*a*, *b* and the compression bars 123 are assembled together, either vertically or horizontally. Then, the strips 124 are heated and placed in position. On cooling, the strips 124 contract to set up the required tension in each strip 124.

Finally, reference is made to FIGS. 18 and 19 which show an embodiment of the invention which uses an annular prestressed frame or ring 125 held in a stressed condition by four identical truncated sector shaped compression members 126. To assemble the structure of FIGS. 18 and 19, the compression members 126 are assembled together and, as before, the ring 125 is then heated to expand it. The ring 125 is then placed over compression members 126, cooled, and screwed in place (with fasteners not shown).

The flat truncated surface 128 of each compression member support wedges 130, 131 which in turn support a movable platen 132. The wedges 130, 131 generally correspond to the wedges 30, 31 described above. The drive means for these wedges 130, 131 and their exact mode of operation is not described here as it is similar to that described above. The platens 132, each of which is similar to the movable platen 20, are guided for radial movement inwardly and outwardly by slots 134 in circular frame side plates 136. One side plate 136 is mounted on each side of the ring 125 and compression members 126. Each wedge 131 is located between two oppositely directed wedges 130. The wedges 130 extend through openings 138 in the top side plates 136 (FIG. 19), whilst the wedges 131 extend through openings 138 in the bottom side plates 136.

In operation, a mold or die 140 to be compressed is suspended (eg. by a hook 142 on its top) and is lowered through a hole 144 in the upper side plate 136 to a position between the movable platens 132. The wedges 130, 131 are then driven in opposite directions inwardly with respect to the whole press (by any desired means as previously discussed). This forces all four movable platens 132 radially inwards against the faces of the mold or die 140 to provide uniform compression.

The press described can also be used for molds, dies or other structures to be compressed, fixed to stationary or movable platforms. In all of the embodiments shown, the movable platens may be provided with springs (not shown) to bias them to a withdrawn position when the wedges are retracted.

Any number of compression members can be used.

I claim:

1. A press comprising:

(a) a frame forming a closed loop;

(b) a first pressure surface disposed within said loop;

(c) a movable platen within said loop, which has a second pressure surface opposed to and spaced from said first pressure surface to permit the introduction between said first and second pressure surfaces of a structure to be compressed;

(d) means supporting said movable platen for movement thereof in a direction towards and away from said first pressure surface;

(e) wedge means acting between said frame and platen for moving the movable platen towards said first pressure surface to compress a structure disposed between said first and second pressure surfaces, said wedge means including first and second wedges which are movable in opposite directions in a plane generally at right angles to said direction of platen movement, said wedges having respective inclined surfaces which taper in opposite directions with respect to said plane and respective support surfaces which are disposed in said plane; said platen having correspondingly inclined surfaces co-operating with said inclined surfaces of the wedge means and adapted to cause movement of the movable platen towards the first pressure surface in response to inward movement of the wedges in said opposite directions; and (f) drive means for propelling said first and second wedges in opposite directions to move said movable pressure surface; said inclined surfaces and drive means being arranged to cause said movement of the movable platen towards said first pressure surface without imparting any substantial lateral force to the movable platen.

2. A press according to claim 1 wherein said frame includes a pair of side members, said movable platen being guided on said side members during movement thereof.

3. A press according to claim 1 wherein said first wedge comprises a pair of wedge members located on either side of said second wedge.

4. A press according to claim 1 wherein the wedge means acts directly between the frame and the movable platen.

5. A press according to claim 4, wherein said means defining correspondingly inclined surfaces co-operating with the inclined surfaces of the wedge means comprise portions of said platen, said first and second wedges being arranged with their inclined surfaces slidingly co-operating with the inclined surfaces of the platen.

6. A press according to claim 1 and including a pair of rails extending into the space between the first and second pressure surfaces, for guiding said structure into said space, said structure including slots at the sides thereof, said slots being of height greater than that of said rails so that when said structure is compressed between said first and second pressure surfaces, said rails do not contact the tops or bottoms of said slots.

7. A press according to claim 1 wherein said structure is a mold or die comprising a pair of separable halves.

8. A press according to claim 1 wherein said frame comprises an upper yoke, a lower yoke, a pair of compression bars mounted between said yokes at the sides thereof, and a pair of tensioned tie bars connecting said yokes, the tension in said tie bars acting to compress said compression members.

9. A press according to claim 8 wherein said tie bars and said yokes have mating teeth connecting said tie bars and said yokes together, the pitch of the teeth on said tie bars being non-uniform under zero tensioning of said tie bars and being proportioned so that under said tensioning of said tie bars, said teeth of said tie bars engage the teeth of said yokes with substantially no gaps at any tooth so that each tooth is under substantially the same stress as each other tooth.

10. A press according to claim 1, wherein said frame comprises a pair of yokes, a pair of compression members between said yokes and a ring encircling the yokes and compression members, with the compression members maintaining said ring in tension.

11. A press according to claim 10, wherein the yokes and the compression members include external slots, in which the ring is seated.

12. A press according to claim 10, wherein the yokes and compression members have plain exterior surfaces and the ring is of the same width as the yokes and the compression members.

13. A press as claimed in claim 1 wherein the frame is pre-stressed and comprises a plurality of individual modules, each of which modules comprises a pair of yokes, and a pair of compression members between said yokes, and a ring encircling the yokes and compression members, with the compression members maintaining said ring in tension.

14. A press according to claim 1 wherein said means (f) comprises hydraulic actuating means including a cylinder a piston in said cylinder, said piston having a rod, and means connecting said cylinder to said first wedge means and said rod to said second wedge means so that when said piston is moved in said cylinder, said first wedge means will move in one direction and said second wedge means will move in the opposite direction.

15. A press according to claim 14 wherein said first and second wedge means each includes rack teeth, and said press includes a pinion means engaging said rack teeth to equalize the movement in opposite directions of said first and second wedge.

16. A press according to claim 1 wherein said first and second wedges include rack teeth, and the press includes pinion means engaging said rack teeth to equalize the movement in opposite directions of said wedges, and means for driving said pinion means to propel said wedges.

17. A press according to claim 1, wherein the frame comprises a prestressed annular ring, and a plurality of compression members within the ring and maintaining the ring in tension.

18. A press as claimed in claim 17, wherein the compression members define two first pressure surfaces and two second pressure surfaces generally opposite the first pressure surfaces, which pressure surfaces define a generally square aperture, and a wedge means is provided adjacent each pressure surface, each wedge means comprising first and second wedges which taper in opposite directions, and a movable platen which can be moved towards a centre of the press by movement of the respective first and second wedges in opposite directions; whereby, in use, a structure to be compressed is located in said square aperture and said first and second wedges are all moved in their respective opposite directions, to compress said structure in two mutually perpendicular directions.

19. A press as claimed in claim 1, wherein at least one of said first and second wedges compirses at least two wedges arranged in a series.

20. A press comprising:

(a) a frame forming a closed loop;

(b) a first pressure surface disposed within said loop;

(c) a movable platen within said loop, which has a second pressure surface opposed to and spaced from said first pressure surface to permit the introduction between said first and second pressure surfaces of a structure to be compressed;

(d) means supporting said movable platen for movement thereof towards and away from said first pressure surface;

(e) wedge means for moving said movable platen towards said first pressure surface to compress a structure disposed between said first and second pressure surfaces, said wedge means including first and second wedges which taper in opposite directions and which are movable in said directions, and means slidably co-operating with said wedge means and adapted to cause movement of the movable platen towards the first pressure surface in response to movement of the wedges in said directions, without imparting any substantial lateral force to the movable platen; and, (f) hydraulic actuating means including a cylinder, a piston in said cylinder, said piston having a rod, and means connecting said cylinder to said first wedge means and said rod to said second wedge means so that when said piston is moved in said cylinder, said first wedge means will move in one direction and said second wedge means will move in the opposite direction.

* * * * *